US008853921B2

(12) United States Patent
Lenk et al.

(10) Patent No.: US 8,853,921 B2
(45) Date of Patent: Oct. 7, 2014

(54) HEAT REMOVAL DESIGN FOR LED BULBS

(71) Applicant: Switch Bulb Company, Inc., San Jose, CA (US)

(72) Inventors: Ronald J. Lenk, Woodstock, GA (US); Carol Lenk, Woodstock, GA (US); Daniel Chandler, Menlo Park, CA (US); Matthew Galla, Mountain View, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 14/011,636

(22) Filed: Aug. 27, 2013

(65) Prior Publication Data

US 2014/0167592 A1 Jun. 19, 2014

Related U.S. Application Data

(63) Continuation of application No. 12/299,003, filed as application No. PCT/US2007/010470 on Apr. 27, 2007, now Pat. No. 8,547,002.

(60) Provisional application No. 60/797,187, filed on May 2, 2006.

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |
| ***F21V 29/00*** | (2006.01) |

(52) U.S. Cl.
CPC ..... *F21V 29/248* (2013.01)
USPC ..... 313/46; 362/294; 362/373

(58) Field of Classification Search
CPC ..... F21Y 2101/02; F21Y 2111/007; F21Y 2111/005; F21Y 2103/003; F21Y 2105/001; F21Y 2111/001; F21Y 2111/002; F21V 29/248; F21V 29/30; F21V 3/005; F21V 31/04; H01L 33/648; H01L 33/641; Y10S 362/80; F21S 10/002; F21S 48/215; H01K 1/58
See application file for complete search history.

(56) References Cited

U.S. PATENT DOCUMENTS

| | | | |
|---|---|---|---|
| 3,962,675 | A | 6/1976 | Rowley et al. |
| 4,025,290 | A | 5/1977 | Giangiulio |

(Continued)

FOREIGN PATENT DOCUMENTS

| | | | |
|---|---|---|---|
| EP | 0658933 | B1 | 10/2001 |
| JP | 63-86484 | A | 4/1988 |

(Continued)

OTHER PUBLICATIONS

Final Office Action received for U.S. Appl. No. 12/299,049, mailed on Jan. 4, 2012, 24 pages.

(Continued)

*Primary Examiner* — Donald Raleigh
(74) *Attorney, Agent, or Firm* — Morrison & Foerster LLP

(57) ABSTRACT

An LED bulb having bulb-shaped shell and thermally conductive fluid or gel within the shell. The bulb includes at least one LED within the shell. The bulb includes at least one LED within the shell and a base. The base can be configured to fit within an electrical socket and can include a series of screw threads and a base pin, wherein the screw threads and base pin are dimensioned to be received within a standard electrical socket. Alternatively, the base can be configured to fit within a suitable electric socket.

20 Claims, 3 Drawing Sheets

(56) References Cited

U.S. PATENT DOCUMENTS 4,039,885 A 8/1977 van Boekhold et al.
4,077,076 A 3/1978 Masters
4,211,955 A 7/1980 Ray
4,271,458 A 6/1981 George, Jr.
4,290,095 A 9/1981 Schmidt
4,325,107 A 4/1982 MacLeod
4,336,855 A 6/1982 Chen
4,346,329 A 8/1982 Schmidt
4,405,744 A 9/1983 Greinecker et al.
4,511,952 A 4/1985 Vanbragt
4,539,516 A 9/1985 Thompson
4,611,512 A 9/1986 Honda
4,647,331 A 3/1987 Koury, Jr. et al.
4,650,509 A 3/1987 Vanbragt
4,656,564 A 4/1987 Felder
4,658,532 A 4/1987 McFarland et al.
4,663,558 A 5/1987 Endo
4,727,289 A 2/1988 Uchida
4,728,999 A 3/1988 Dannatt et al.
4,840,383 A 6/1989 Lombardo
4,843,266 A 6/1989 Szanto et al.
4,875,852 A 10/1989 Ferren
4,876,632 A 10/1989 Osterhout et al.
4,904,991 A 2/1990 Jones
4,916,352 A 4/1990 Haim et al.
4,942,685 A 7/1990 Lin
4,947,300 A 8/1990 Wen
4,967,330 A 10/1990 Bell et al.
4,994,705 A 2/1991 Linder et al.
5,008,588 A 4/1991 Nakahara
5,065,226 A 11/1991 Kluitmans et al.
5,065,291 A 11/1991 Frost et al.
5,119,831 A 6/1992 Robin et al.
5,136,213 A 8/1992 Sacchetti
5,224,773 A 7/1993 Arimura
5,237,490 A 8/1993 Ferng
5,303,124 A 4/1994 Wrobel
5,358,880 A 10/1994 Lebby et al.
5,377,000 A 12/1994 Berends
5,405,208 A 4/1995 Hsieh
5,463,280 A 10/1995 Johnson
5,496,184 A 3/1996 Garrett et al.
5,514,627 A 5/1996 Lowery et al.
5,528,474 A 6/1996 Roney et al.
5,561,347 A 10/1996 Nakamura et al.
5,585,783 A 12/1996 Hall
5,622,423 A 4/1997 Lee
5,630,660 A 5/1997 Chen
5,662,490 A 9/1997 Ogawa
5,664,866 A 9/1997 Reniger et al.
5,667,295 A 9/1997 Tsui
5,684,354 A 11/1997 Gleckman
5,685,637 A 11/1997 Chapman et al.
5,688,042 A 11/1997 Madadi et al.
5,726,535 A 3/1998 Yan
5,803,588 A 9/1998 Costa
5,807,157 A 9/1998 Penjuke
5,887,967 A 3/1999 Chang
5,890,794 A 4/1999 Abtahi et al.
5,892,325 A 4/1999 Gleckman
5,899,557 A 5/1999 McDermott
5,929,568 A 7/1999 Eggers
5,931,562 A 8/1999 Arato
5,931,570 A 8/1999 Yamuro
5,936,599 A 8/1999 Reymond
5,941,626 A 8/1999 Yamuro
5,947,588 A 9/1999 Huang
5,952,916 A 9/1999 Yamabe
5,963,126 A 10/1999 Karlin et al.
5,982,059 A 11/1999 Anderson
5,984,494 A 11/1999 Chapman et al.
6,003,033 A 12/1999 Amano et al.
6,043,591 A 3/2000 Gleckman
6,087,764 A 7/2000 Matei
6,095,671 A 8/2000 Hutain
6,102,809 A 8/2000 Nichols
6,120,312 A 9/2000 Shu
6,123,631 A 9/2000 Ginder
6,147,367 A 11/2000 Yang et al.
6,158,451 A 12/2000 Wu
6,183,310 B1 2/2001 Shu
6,184,628 B1 2/2001 Ruthenberg
6,227,679 B1 5/2001 Zhang et al.
6,254,939 B1 7/2001 Cowan et al.
6,258,699 B1 7/2001 Chang et al.
6,268,801 B1 7/2001 Wu
6,273,580 B1 8/2001 Coleman et al.
6,276,822 B1 8/2001 Bedrosian et al.
6,277,685 B1 8/2001 Lin et al.
6,313,892 B2 11/2001 Gleckman
6,316,911 B1 11/2001 Moskowitz et al.
6,332,692 B1 12/2001 McCurdy
6,338,647 B1 1/2002 Fernandez et al.
6,357,902 B1 3/2002 Horowitz
6,382,582 B1 5/2002 Brown
6,426,704 B1 7/2002 Hutchison
6,471,562 B1 10/2002 Liu
6,478,449 B2 11/2002 Lee et al.
6,480,389 B1 11/2002 Shie et al.
6,488,392 B1 12/2002 Lu
6,496,237 B1 12/2002 Gleckman
6,504,301 B1 1/2003 Lowery
6,513,955 B1 2/2003 Waltz
6,523,976 B1 2/2003 Turnbull et al.
6,528,954 B1 3/2003 Lys et al.
6,534,988 B2 3/2003 Flory, IV
6,541,800 B2 4/2003 Barnett et al.
6,547,417 B2 4/2003 Lee
6,568,834 B1 5/2003 Scianna
6,582,100 B1 6/2003 Hochstein et al.
6,608,272 B2 8/2003 Garcia
6,612,712 B2 9/2003 Nepil
6,619,829 B1 9/2003 Chen
6,626,557 B1 9/2003 Taylor
6,639,360 B2 10/2003 Roberts et al.
6,655,810 B2 12/2003 Hayashi et al.
6,659,632 B2 12/2003 Chen
6,685,852 B2 2/2004 Setlur et al.
6,709,132 B2 3/2004 Ishibashi
6,711,426 B2 3/2004 Benaron et al.
6,713,961 B2 3/2004 Honda et al.
6,734,633 B2 5/2004 Matsuba et al.
6,741,029 B2 5/2004 Matsubara et al.
6,742,907 B2 6/2004 Funamoto et al.
6,746,885 B2 6/2004 Cao
6,750,824 B1 6/2004 Shen
6,773,192 B1 8/2004 Chao
6,786,625 B2 9/2004 Wesson
6,789,348 B1 9/2004 Kneller et al.
6,791,259 B1 9/2004 Stokes et al.
6,791,283 B2 9/2004 Bowman et al.
6,793,362 B2 9/2004 Tai
6,793,363 B2 9/2004 Jensen
6,796,698 B2 9/2004 Sommers et al.
6,805,461 B2 10/2004 Witte
6,819,049 B1 11/2004 Bohmer et al.
6,819,056 B2 11/2004 Lin
6,828,590 B2 12/2004 Hsiung
6,864,513 B2 3/2005 Lin et al.
6,864,554 B2 3/2005 Lin et al.
6,881,980 B1 4/2005 Ting
6,886,963 B2 5/2005 Lodhie
6,903,380 B2 6/2005 Barnett et al.
6,905,231 B2 6/2005 Dickie
6,910,794 B2 6/2005 Rice
6,911,678 B2 6/2005 Fujisawa et al.
6,911,915 B2 6/2005 Wu et al.
6,926,973 B2 8/2005 Suzuki et al.
6,927,683 B2 8/2005 Sugimoto et al.
6,932,638 B1 8/2005 Burrows et al.
6,936,857 B2 8/2005 Doxsee et al.
6,943,357 B2 9/2005 Srivastava et al.
6,948,829 B2 9/2005 Verdes et al.
6,956,243 B1 10/2005 Chin

(56) References Cited

U.S. PATENT DOCUMENTS 6,964,878 B2 11/2005 Horng et al.
6,967,445 B1 11/2005 Jewell et al.
6,971,760 B2 12/2005 Archer et al.
6,974,924 B2 12/2005 Agnatovech et al.
6,982,518 B2 1/2006 Chou et al.
6,983,506 B1 1/2006 Brown
7,022,260 B2 4/2006 Morioka
7,042,150 B2 5/2006 Yasuda
7,058,103 B2 6/2006 Ishida et al.
D525,374 S 7/2006 Maxik et al.
7,073,920 B2 7/2006 Konkle, Jr. et al.
7,074,631 B2 7/2006 Erchak et al.
7,075,112 B2 7/2006 Roberts et al.
7,078,732 B1 7/2006 Reeh et al.
D527,119 S 8/2006 Maxik et al.
7,086,756 B2 8/2006 Maxik
7,086,767 B2 8/2006 Sidwell et al.
D528,673 S 9/2006 Maxik et al.
D531,740 S 11/2006 Maxik
D532,532 S 11/2006 Maxik
7,138,666 B2 11/2006 Erchak et al.
7,161,311 B2 1/2007 Mueller et al.
7,186,016 B2 3/2007 Jao
7,213,934 B2 5/2007 Zarian et al.
7,239,080 B2 7/2007 Ng et al.
7,241,039 B2 7/2007 Hulse
7,246,919 B2 7/2007 Porchia et al.
7,261,454 B2 8/2007 Ng
7,270,446 B2 9/2007 Chang et al.
7,288,798 B2 10/2007 Chang et al.
7,315,119 B2 1/2008 Ng et al.
7,319,293 B2 1/2008 Maxik
7,344,279 B2 3/2008 Mueller et al.
7,350,933 B2 4/2008 Ng et al.
7,367,692 B2 5/2008 Maxik
7,396,142 B2 7/2008 Laizure, Jr. et al.
7,489,031 B2 2/2009 Roberts et al.
7,513,669 B2 4/2009 Chua et al.
7,524,097 B2 4/2009 Turnbull et al.
7,550,319 B2 6/2009 Wang et al.
7,677,765 B2 3/2010 Tajul et al.
8,075,172 B2 12/2011 Davey et al.
2001/0008436 A1 7/2001 Gleckman
2001/0009400 A1 7/2001 Maeno et al.
2001/0019134 A1 9/2001 Chang et al.
2001/0026447 A1 10/2001 Herrera
2001/0035264 A1 11/2001 Padmanabhan
2001/0053077 A1 12/2001 Anwly-Davies et al.
2002/0021573 A1 2/2002 Zhang
2002/0039872 A1 4/2002 Asai et al.
2002/0068775 A1 6/2002 Munzenberger
2002/0070449 A1 6/2002 Yagi et al.
2002/0085379 A1 7/2002 Han et al.
2002/0093287 A1 7/2002 Chen
2002/0097586 A1 7/2002 Horowitz
2002/0113244 A1 8/2002 Barnett et al.
2002/0117692 A1 8/2002 Lin
2002/0126491 A1 9/2002 Chen
2002/0145863 A1 10/2002 Stultz
2002/0149312 A1 10/2002 Roberts et al.
2002/0153829 A1 10/2002 Asai et al.
2002/0154449 A1 10/2002 Raphael et al.
2002/0176246 A1 11/2002 Chen
2002/0183438 A1 12/2002 Amarasekera et al.
2002/0186538 A1 12/2002 Kase et al.
2002/0191416 A1 12/2002 Wesson
2003/0025449 A1 2/2003 Rossner
2003/0043579 A1 3/2003 Rong et al.
2003/0048632 A1 3/2003 Archer
2003/0058658 A1 3/2003 Lee
2003/0072156 A1 4/2003 Pohlert et al.
2003/0079387 A1 5/2003 Derose
2003/0111955 A1 6/2003 McNulty et al.
2003/0128629 A1 7/2003 Stevens
2003/0142508 A1 7/2003 Lee
2003/0164666 A1 9/2003 Crunk
2003/0185020 A1 10/2003 Stekelenburg
2003/0193841 A1 10/2003 Crunk
2003/0201903 A1 10/2003 Shen
2003/0230045 A1 12/2003 Krause et al.
2003/0231510 A1 12/2003 Tawa et al.
2004/0001338 A1 1/2004 Pine
2004/0004435 A1 1/2004 Hsu
2004/0004441 A1 1/2004 Yano
2004/0007980 A1 1/2004 Shibata
2004/0008525 A1 1/2004 Shibata
2004/0014414 A1 1/2004 Horie et al.
2004/0039274 A1 2/2004 Benaron et al.
2004/0039764 A1 2/2004 Gonikberg et al.
2004/0056600 A1 3/2004 Lapatovich et al.
2004/0085017 A1 5/2004 Lee
2004/0085758 A1 5/2004 Deng
2004/0101802 A1 5/2004 Scott
2004/0105262 A1 6/2004 Tseng et al.
2004/0113549 A1 6/2004 Roberts et al.
2004/0114352 A1 6/2004 Jensen
2004/0114367 A1 6/2004 Li
2004/0125034 A1 7/2004 Shen
2004/0125515 A1 7/2004 Popovich
2004/0127138 A1 7/2004 Huang
2004/0179355 A1 9/2004 Gabor
2004/0183458 A1 9/2004 Lee
2004/0187313 A1 9/2004 Zirk et al.
2004/0189262 A1 9/2004 McGrath
2004/0190305 A1 9/2004 Arik et al.
2004/0201673 A1 10/2004 Asai
2004/0207334 A1 10/2004 Lin
2004/0208002 A1 10/2004 Wu
2004/0211589 A1 10/2004 Chou et al.
2004/0217693 A1 11/2004 Duggal et al.
2004/0233661 A1 11/2004 Taylor
2004/0245912 A1 12/2004 Thurk et al.
2004/0257804 A1 12/2004 Lee
2004/0264192 A1 12/2004 Nagata et al.
2005/0007010 A1 1/2005 Lee
2005/0007770 A1 1/2005 Bowman et al.
2005/0011481 A1 1/2005 Naumann et al.
2005/0015029 A1 1/2005 Kim
2005/0018424 A1 1/2005 Popovich
2005/0023540 A1 2/2005 Yoko et al.
2005/0030761 A1 2/2005 Burgess
2005/0031281 A1 2/2005 Nath
2005/0036299 A1 2/2005 Tsai
2005/0036616 A1 2/2005 Huang et al.
2005/0047170 A1 3/2005 Hillburger et al.
2005/0052885 A1 3/2005 Wu
2005/0057187 A1 3/2005 Catalano
2005/0063185 A1 3/2005 Monjo et al.
2005/0067343 A1 3/2005 Zulauf et al.
2005/0068776 A1 3/2005 Ge
2005/0084229 A1 4/2005 Babbitt et al.
2005/0099787 A1 5/2005 Hayes
2005/0105302 A1 5/2005 Hofmann et al.
2005/0110191 A1 5/2005 Lin
2005/0110384 A1 5/2005 Peterson
2005/0111234 A1 5/2005 Martin et al.
2005/0129979 A1 6/2005 Kambe et al.
2005/0141221 A1 6/2005 Yu
2005/0151664 A1 7/2005 Kolish et al.
2005/0152136 A1 7/2005 Konkle et al.
2005/0162864 A1 7/2005 Verdes et al.
2005/0174065 A1 8/2005 Janning
2005/0174769 A1 8/2005 Yong et al.
2005/0174780 A1 8/2005 Park
2005/0179358 A1 8/2005 Soules et al.
2005/0180136 A9 8/2005 Popovich
2005/0180137 A1 8/2005 Hsu
2005/0190561 A1 9/2005 Ng et al.
2005/0207152 A1 9/2005 Maxik
2005/0207159 A1 9/2005 Maxik
2005/0217996 A1 10/2005 Liu et al.
2005/0224829 A1 10/2005 Negley et al.
2005/0230691 A1 10/2005 Amiotti et al.
2005/0233485 A1 10/2005 Shishov et al.

(56) References Cited

U.S. PATENT DOCUMENTS

| | | | |
|---|---|---|---|
| 2005/0237995 | A1 | 10/2005 | Puranik |
| 2005/0243539 | A1 | 11/2005 | Evans et al. |
| 2005/0243550 | A1 | 11/2005 | Stekelenburg |
| 2005/0243552 | A1 | 11/2005 | Maxik |
| 2005/0255026 | A1 | 11/2005 | Barker et al. |
| 2005/0258446 | A1 | 11/2005 | Raos et al. |
| 2005/0259419 | A1 | 11/2005 | Sandoval |
| 2005/0265039 | A1 | 12/2005 | Lodhie et al. |
| 2005/0270780 | A1 | 12/2005 | Zhang |
| 2005/0276034 | A1 | 12/2005 | Malpetti |
| 2005/0276051 | A1 | 12/2005 | Caudle et al. |
| 2005/0276053 | A1 | 12/2005 | Nortrup et al. |
| 2005/0276072 | A1 | 12/2005 | Hayashi et al. |
| 2005/0285494 | A1 | 12/2005 | Cho et al. |
| 2006/0002110 | A1 | 1/2006 | Dowling et al. |
| 2006/0007410 | A1 | 1/2006 | Masuoka et al. |
| 2006/0034077 | A1 | 2/2006 | Chang |
| 2006/0044803 | A1 | 3/2006 | Edwards |
| 2006/0050514 | A1 | 3/2006 | Opolka |
| 2006/0061985 | A1 | 3/2006 | Elkins |
| 2006/0071591 | A1 | 4/2006 | Takezawa et al. |
| 2006/0092644 | A1 | 5/2006 | Mok et al. |
| 2006/0142946 | A1 | 6/2006 | Goujon et al. |
| 2006/0145172 | A1 | 7/2006 | Su et al. |
| 2006/0158886 | A1 | 7/2006 | Lee |
| 2006/0176699 | A1 | 8/2006 | Crunk |
| 2006/0187653 | A1 | 8/2006 | Olsson |
| 2006/0193121 | A1 | 8/2006 | Kamoshita |
| 2006/0193130 | A1 | 8/2006 | Ishibashi |
| 2006/0198147 | A1 | 9/2006 | Ge |
| 2006/0208260 | A1 | 9/2006 | Sakuma et al. |
| 2006/0226772 | A1 | 10/2006 | Tan et al. |
| 2006/0243997 | A1 | 11/2006 | Yang et al. |
| 2006/0250802 | A1 | 11/2006 | Herold |
| 2006/0255353 | A1 | 11/2006 | Taskar et al. |
| 2006/0261359 | A1 | 11/2006 | Huang |
| 2006/0273340 | A1 | 12/2006 | Lv |
| 2006/0274524 | A1 | 12/2006 | Chang et al. |
| 2006/0289884 | A1 | 12/2006 | Soules et al. |
| 2007/0018181 | A1 | 1/2007 | Steen et al. |
| 2007/0057364 | A1 | 3/2007 | Wang et al. |
| 2007/0086189 | A1 | 4/2007 | Raos et al. |
| 2007/0090391 | A1 | 4/2007 | Diamantidis |
| 2007/0090737 | A1 | 4/2007 | Hu et al. |
| 2007/0120879 | A1 | 5/2007 | Kanade et al. |
| 2007/0125982 | A1 | 6/2007 | Tian et al. |
| 2007/0139949 | A1 | 6/2007 | Tanda et al. |
| 2007/0153518 | A1 | 7/2007 | Chen |
| 2007/0291490 | A1 | 12/2007 | Tajul et al. |
| 2008/0013316 | A1 | 1/2008 | Chiang |
| 2008/0048200 | A1 | 2/2008 | Mueller et al. |
| 2008/0070331 | A1 | 3/2008 | Ke |
| 2009/0001372 | A1 | 1/2009 | Arik et al. |
| 2009/0324875 | A1 | 12/2009 | Heikkila |
| 2010/0177534 | A1 | 7/2010 | Ryu et al. |

FOREIGN PATENT DOCUMENTS

| | | | |
|---|---|---|---|
| JP | 7-99372 | A | 4/1995 |
| JP | 33-51103 | B2 | 9/2002 |
| JP | 2003-16806 | A | 1/2003 |
| WO | 02/061805 | A2 | 8/2002 |
| WO | 2004/100213 | A2 | 11/2004 |
| WO | 2005/060309 | A2 | 6/2005 |
| WO | 2007/069119 | A1 | 6/2007 |

OTHER PUBLICATIONS

Non Final Office Action received for U.S. Appl. No. 12/299,049, mailed on Jun. 16, 2011, 74 pages.

Non Final Office Action received for U.S. Appl. No. 12/299,049, mailed on Mar. 16, 2012, 11 pages.

Final Office Action received for U.S. Appl. No. 12/299,003, mailed on Oct. 5, 2011, 16 pages.

Non Final Office Action received for U.S. Appl. No. 12/299,003, mailed on Apr. 15, 2011, 60 pages.

Non Final Office Action received for U.S. Appl. No. 12/299,003, mailed on Jun. 13, 2012, 23 pages.

Office Action received for Chinese Patent Application No. 200780015112.2, mailed on Apr. 8, 2010, 25 pages (16 pages of English translation and 9 pages of Office Action).

Final Office Action received for U.S. Appl. No. 12/299,049, mailed on Sep. 5, 2012, 15 pages.

Non Final Office Action received for U.S. Appl. No. 12/681,774, mailed on Oct. 4, 2012, 52 pages.

International Preliminary Report on Patentability and Written Opinion received for PCT Patent Application No. PCT/US2007/010469, issued on Nov. 4, 2008, 12 pages.

International Search Report received for PCT Patent Application No. PCT/US2007/010469, mailed on Aug. 7, 2008, 2 pages.

International Search Report received for PCT Patent Application No. PCT/US2007/010470, mailed on Sep. 29, 2008, 7 pages.

International Preliminary Report on Patentability and Written Opinion received for PCT Patent Application No. PCT/US2007/10470, issued on Nov. 27, 2008, 5 pages.

International Search Report and Written Opinion received for PCT Patent Application No. PCT/US2008/011365, mailed on Dec. 5, 2008, 6 pages.

International Preliminary Report on Patentability received for PCT Patent Application No. PCT/US2008/011365, mailed on Apr. 15, 2010, 7 pages.

Office Action received for New Zealand Patent Application No. 573336, mailed on Apr. 19, 2010, 2 pages.

Supplementary European Search Report and Search Opinion received for European Patent Application No. 07776519.6, mailed on Sep. 24, 2010, 8 pages.

Notice of Allowance received for U.S. Appl. No. 12/299,003, mailed on May 24, 2013, 9 pages.

Final Office Action received for U.S. Appl. No. 12/299,003, mailed on Jan. 7, 2013, 13 pages.

HEAT REMOVAL DESIGN FOR LED BULBS

CROSS-REFERENCE TO RELATED APPLICATIONS

This application is a continuation of U.S. patent application Ser. No. 12/299,003, now U.S. Pat. No. 8,547,002, which is a National Phase patent application of PCT/US2007/010470, filed Apr. 27, 2007, which claims priority to U.S. Provisional Patent Application No. 60/797,187, filed May 2, 2006, each of which is hereby incorporated by reference in the present disclosure in its entirety.

FIELD OF THE INVENTION

The present invention relates to replacement of bulbs used for lighting by light emitting diode (LED) bulbs, and more particularly, to the efficient removal of the heat generated by the LEDs in order to permit the replacement bulb to match the light output of the bulb being replaced.

BACKGROUND OF THE INVENTION

An LED consists of a semiconductor junction, which emits light due to a current flowing through the junction. At first sight, it would seem that LEDs should make an excellent replacement for the traditional tungsten filament incandescent bulb. At equal power, they give far more light output than do incandescent bulbs, or, what is the same thing, they use much less power for equal light; and their operational life is orders of magnitude larger, namely, 10-100 thousand hours vs. 1-2 thousand hours.

However, LEDs have a number of drawbacks that have prevented them, so far, from being widely adopted as incandescent replacements. Among the chief of these is that, although LEDs require substantially less power for a given light output than do incandescent bulbs, it still takes many watts to generate adequate light for illumination. Whereas the tungsten filament in an incandescent bulb operates at a temperature of approximately 3000° (degrees) K, an LED, being a semiconductor, cannot be allowed to get hotter than approximately 120° C. The LED thus has a substantial heat problem: If operated in vacuum like an incandescent, or even in air, it would rapidly get too hot and fail. This has limited available LED bulbs to very low power (i.e., less than approximately 3 W), producing insufficient illumination for incandescent replacements. One additional method for getting a "white LED" is to use a colored cover over a blue or other colored LED, such as that made by JKL Lamps™. However, this involves significant loss of light.

One possible solution to this problem is to use a large metallic heatsink, attached to the LEDs. This heatsink would then extend out away from the bulb, removing the heat from the LEDs. This solution is undesirable, and in fact has not been tried, because of the common perception that customers will not use a bulb that is shaped radically differently from the traditionally shaped incandescent bulb; and also from the consideration that the heatsink may make it impossible for the bulb to fit in to pre-existing fixtures.

This invention has the object of developing a light emitting apparatus utilizing light emitting diodes (LEDs), such that the above-described primary problem is effectively solved. It aims at providing a replacement bulb for incandescent lighting having a plurality of LEDs with a light output equal in intensity to that of an incandescent bulb, and whose dissipated power may be effectively removed from the LEDs in such a way that their maximum rated temperature is not exceeded. The apparatus includes a bulb-shaped shell, preferably formed of a plastic such as polycarbonate. The shell and/or the bulb may be transparent, or may contain materials dispersed in it to disperse the light, making it appear not to have point sources of light, and may also contain materials dispersed in it to change the bluish color of the LED light to more yellowish color, more closely resembling the light from normal incandescent bulbs.

SUMMARY OF THE INVENTION

In accordance with one embodiment, an LED bulb comprises: a bulb-shaped shell, wherein the shell may be any shape, or any of the other conventional or decorative shapes used for bulbs; a thermally conductive fluid within the bulb-shaped shell; at least one LED within the bulb-shaped shell; and a base dimensioned to be received within an electrical socket.

In accordance with another embodiment, a method of manufacturing an LED bulb comprises: creating a plastic bulb-shaped shell; at least partially filling the shell with a fluid, wherein the fluid is thermally conductive; and installing at least one LED in the fluid.

In accordance with a further embodiment, a method of manufacturing an LED bulb comprises: creating a plastic bulb-shaped shell; installing at least one LED within the plastic bulb-shaped shell; and at least partially filling the shell with a fluid, wherein the fluid is thermally conductive.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
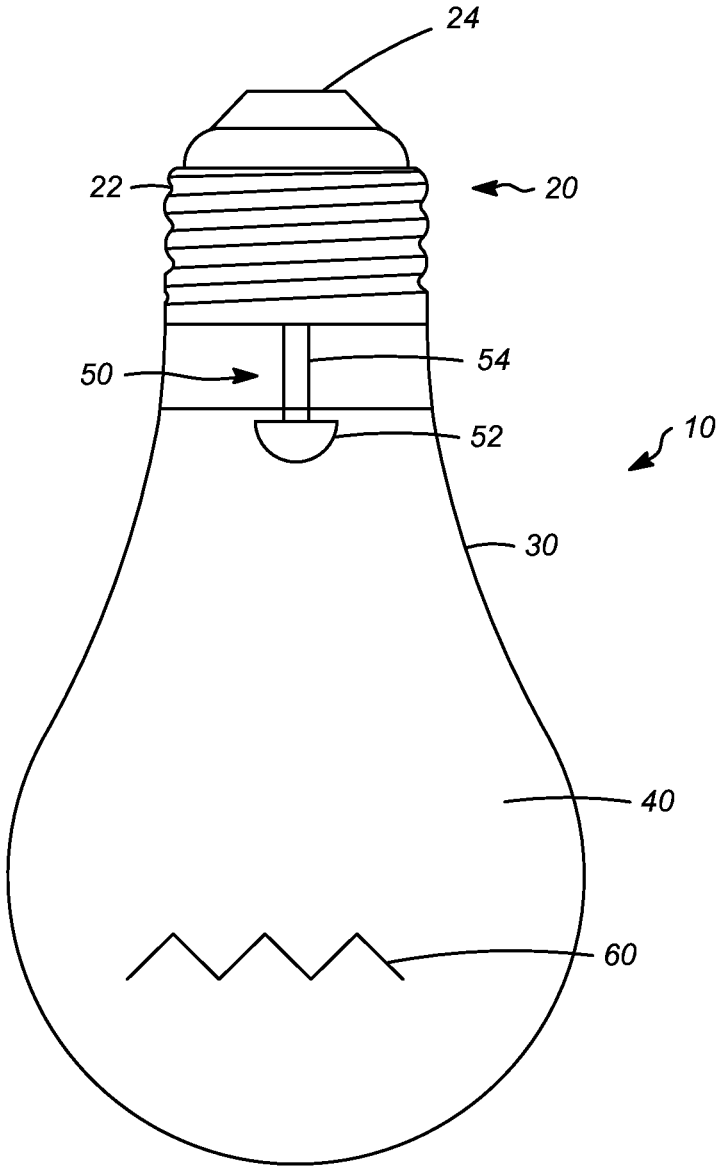
FIG. 1 is a cross-sectional view of an LED replacement bulb showing the light-emitting portion of an LED mounted in a fluid.

Reference will now be made in detail to the present preferred embodiments of the invention, examples of which are illustrated in the accompanying drawings. Wherever possible, the same reference numbers are used in the drawings and the description to refer to the same or like parts. According to the design characteristics, a detailed description of each preferred embodiment is given below.

FIG. 1 shows a cross-sectional view of an LED replacement bulb 10 showing the light-emitting portion of the LED mounted in a fluid according to one embodiment. As shown in FIG. 1, the LED replacement bulb 10 includes a screw-in base 20, a plastic shell 30, a fluid filled inner portion 40, and at least one LED 50. The screw-in base 20 includes a series of screw threads 22 and a base pin 24. The screw-in base 20 is configured to fit within and make electrical contact with a standard electrical socket. The electrical socket is preferably dimensioned to receive an incandescent or other standard light bulb as known in the art. However, it can be appreciated that the screw-in base 20 can be modified to fit within any electrical socket, which is configured to receive an incandescent bulb, such as a bayonet style base. The screw-in base 20 makes electrical contact with the AC power in a socket through its screw threads 22 and its base pin 24. Inside the screw-in base 20 is a power supply (not shown) that converts the AC power to a form suitable for driving the at least one LED 50. The power supply may also be located somewhere other than in the base, either in the bulb or completely external to it.

The at least one LED 50 includes a light emitting portion 52 and a pair of connecting wires 54, which are connected to the power supply. Typically, the light emitting portion 52 of an LED 50 consists of a die, a lead frame where the die is actually placed, and the encapsulation epoxy, which surrounds and protects the die and disperses and color-shifts the light. The die is bonded with conductive epoxy into a recess in one half of the lead frame, called the anvil due to its shape. The recess in the anvil is shaped to project the radiated light forward. The die's top contact wire is bonded to the other lead frame terminal, or post. It can be appreciated that the example set forth is only one embodiment of an LED and that other suitable LED 50 configurations can be used. As shown in FIG. 1, the shell 30 entirely encases the fluid-filled volume 40 so as to prevent leakage. The shell 30 also encases the at least the light-emitting portion 52 of the LED or LEDs 50, with the connecting wires 54 coming out through the shell 30 through a sealed connection to the power supply. It can be appreciated that the shell 30 (or enclosure) may be any shape, or any of the other conventional or decorative shapes used for bulbs, including but not limited to spherical, cylindrical, and "flame" shaped shells 30. Alternatively, the shell 30 could be a tubular element, as used in compact florescent lamps or other designs.

The shell 30 is filled, either completely or partially, with a thermally conductive fluid 60, such as water or a mineral oil. However, it can be appreciated that any suitable gel material can be used in place of the fluid 60, for example one which upon exposure to atmospheric pressure and/or air gels to prevents the fluid 60 from escaping from the bulb 10 if damaged or broken. For example, the gel like material can be hydrogenated poly (2-hydroxyethyl methacrylate). The fluid 60 acts as the means to transfer the heat generated by the LEDs 50 to the shell 30, where it may be removed by radiation and convection, as in a normal incandescent bulb. The fluid 60 may be transparent, or may contain materials dispersed in it to disperse the light, making it appear not to have point sources of light, and may also contain materials dispersed in it to change the bluish color of the LED light to more yellowish color, more closely resembling the light from normal incandescent bulbs. The fluid 60 is preferably electrically insulating. In addition, the fluid 60 is preferably in a static state within the shell 30.

The LEDs 50 are installed in the fluid in such a way as to prevent them from being shorted. If the fluid is electrically insulating, no special measures need to be taken. However, if the fluid is not electrically insulating, the electrically conductive portions of the LEDs 50 may be electrically insulated to prevent shorting.

When the at least one LED 50 or plurality of LEDs 50 are installed in the fluid 60, the shell 30 is sealed with a watertight seal, preferably with the same material as the shell 30. The electrical contacts for powering the LEDs 50 are brought out through the seal before the sealing is accomplished. These leads are connected to the power source for the LEDs, which will preferentially be included inside the remainder of the bulb. The power source is preferably designed to be compatible with pre-existing designs, so that the bulb may directly replace traditional bulbs without requiring any change in the pre-existing fixture.

In another embodiment, the shell 30 and/or the fluid 60 can include a plurality of bubbles (not shown), wherein the bubbles disperse the light from the at least one LED 50. In yet another embodiment, a dye (not shown) can be added to the shell 30 or the fluid 60 within the shell 30, wherein the dye shifts the light of the at least one LED 50 from a first color spectrum to a second color spectrum.

Figure 2:
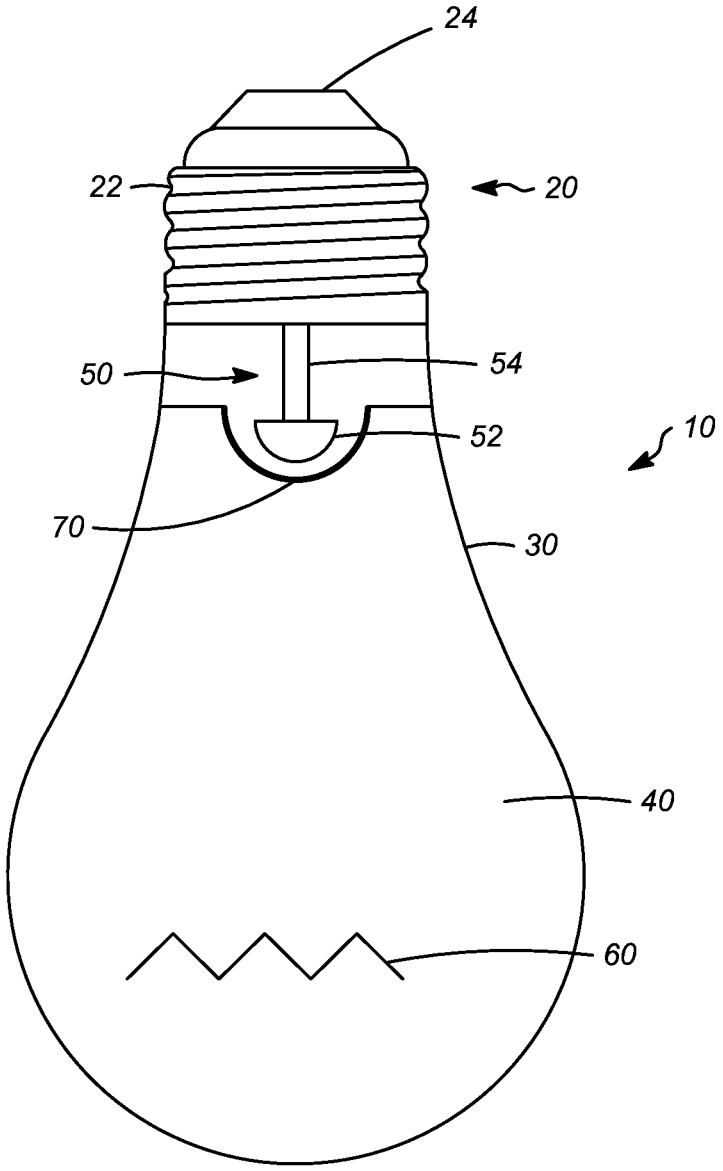
FIG. 2 is a cross-sectional view of an LED replacement bulb showing an LED embedded in the shell, while remaining in thermal contact with the fluid.

FIG. 2 shows a cross-sectional view of an LED replacement bulb 10 showing the LED 50 embedded in the shell, while remaining in thermal contact with the fluid 60 according to a further embodiment of this invention. The LED replacement bulb 10 includes a screw-in base 20, a shell 202, a fluid-filled volume 40, and at least one LED 50 with light-emitting part or parts 52. The screw-in base 20 makes electrical contact with the AC power in a socket through its screw threads 22 and its base pin 24. Inside the screw-in base 20 is a power supply (not shown) that converts the AC power to a form suitable for driving the at least one LED 50. The LED or LEDs 50 are comprised of two parts, connecting wires 54 that connect them to the power supply, and the LED or LEDs 52 themselves. The shell 30 entirely encases the fluid-filled volume 40 so as to prevent leakage. The shell 30 also encases the LED or LEDs 50, with the connecting wires 54 connecting to the power supply. In this embodiment, the LED or LEDs 50 are thermally connected to the fluid 40 through a thin shell-wall 70. This shell-wall 70 provides a low thermal resistance path to the fluid 40 for the heat dissipated by the LED or LEDs 50.

Figure 3:
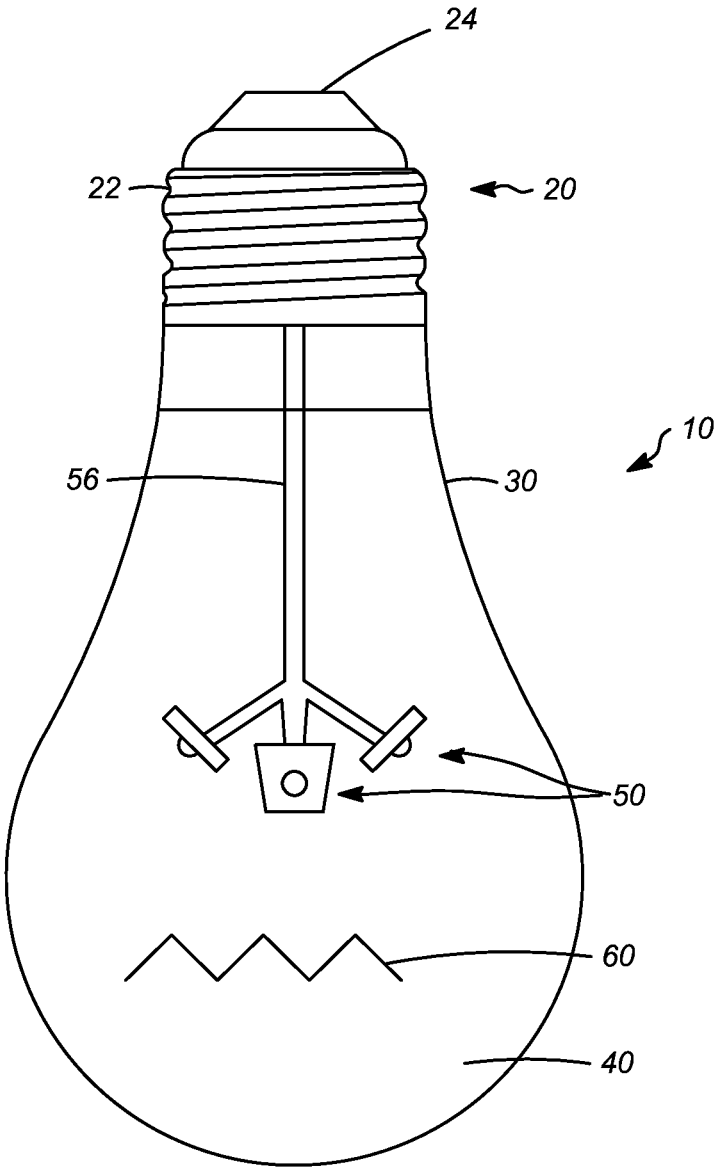
FIG. 3 is a cross-sectional view of an LED replacement bulb showing a plurality of LEDs mounted in a fluid.

FIG. 3 shows a cross-sectional view of an LED replacement bulb 10 comprising a plurality of LEDs 50 mounted in the fluid according to another embodiment of this invention. The LED replacement bulb mainly includes a screw-in base 20, a shell 30, a fluid-filled volume 40, and a plurality of LEDs 50 with connector and support 56. The plurality of LEDs 50 are preferably at least 3 or 4 LED dies arranged to distribute the light source in a suitable configuration. In one embodiment, the plurality of LEDs 50 can be arranged in a tetrahedral configuration. The screw-in base 20 makes electrical contact with the AC power in a socket through its screw threads 22 and its base pin 24. Inside the screw-in base 20 is a power supply (not shown) that converts the AC power to a form suitable for driving the LED or LEDs. The LED or LEDs 50 are comprised of two parts, the connecting wires 56 that connect them to the power supply, and the LED or LEDs 50 themselves. The connecting wires 56 are stiff enough to function as support for the LED or LEDs 50, and also form the interconnects between the LEDs 50 when there are multiple devices. The shell 30 entirely encases the fluid-filled volume 40 so as to prevent leakage. The shell 30 also encases at least the LED or LEDs 50, with the connecting wires 56 coming out through the shell 30 through a sealed connection to the power supply. It can be appreciated that in another embodiment, the support may be a different material from the interconnections or connections.

It can be appreciated that the LED replacement bulbs as shown in FIGS. 1-3 are shown as replacement bulbs for standard incandescent bulbs, however, the bulbs 10 and methods as set forth herein can be adapted to usage with any other powering system or configuration, and can be used for any lighting system, including flashlights, headlights for automobiles or motorcycles, and lanterns.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light emitting diode (LED) bulb comprising:

a shell;

a thermally conductive liquid in contact with the shell;

a plurality of LEDs thermally connected to the thermally conductive liquid, wherein the thermally conductive liquid and the shell are the only means to transfer heat generated by the plurality of LEDs;

a base, wherein the base is configured to receive electrical power; and a support extending into the shell, wherein the plurality of LEDs is connected to the support.

2. The LED bulb as set forth in claim 1, further comprising a power source connected to the plurality of LEDs, and wherein the power source is compatible with pre-existing power sources, permitting the bulb to be used in pre-existing fixtures.

3. The LED bulb as set forth in claim 1, wherein the plurality of LEDs is thermally connected to the liquid through a shell-wall.

4. The LED bulb as set forth in claim 1, wherein the liquid is static.

5. The LED bulb as set forth in claim 1, wherein the liquid gels when exposed to air.

6. The LED bulb as set forth in claim 1, wherein the liquid is mineral oil.

7. The LED bulb as set forth in claim 1, wherein the liquid is water.

8. The LED bulb as set forth in claim 1, further comprising a plurality of bubbles within the liquid, wherein the bubbles are configured to disperse the light from the plurality of LEDs.

9. The LED bulb as set forth in claim 1, further comprising a dye added to the liquid, wherein the dye shifts the light of an LED in the plurality of LEDs from a first color spectrum to a second color spectrum.

10. The LED bulb as set forth in claim 1, further comprising a dye added to the shell, wherein the dye shifts the light of an LED in the plurality of LEDs from a first color spectrum to a second color spectrum.

11. The LED bulb as set forth in claim 1 wherein the plurality of LEDs is configured to emit light through the thermally conductive liquid and the shell.

12. The LED bulb as set forth in claim 1, wherein the LEDs are positioned proximate the middle of the interior volume of the shell.

13. A light emitting diode (LED) bulb comprising:

a shell;

a thermally conductive liquid within the shell, wherein the thermally conductive liquid is thermally connected to the shell;

a plurality of LEDs thermally connected to the thermally conductive liquid, wherein the thermally conductive liquid and the shell are the only means to transfer heat generated by the plurality of LEDs;

a base, wherein the base is configured to receive electrical power; and a support within the shell, wherein the plurality of LEDs is connected to the support.

14. The LED bulb as set forth in claim 13, further comprising a power source connected to the plurality of LEDs, and wherein the power source is compatible with pre-existing power sources, permitting the bulb to be used in pre-existing fixtures.

15. The LED bulb as set forth in claim 13 wherein the plurality of LEDs is configured to emit light through the thermally conductive liquid and the shell.

16. A method of manufacturing a light emitting diode (LED) bulb comprising:

creating a shell;

at least partially filling the interior of the shell with a thermally conductive liquid, wherein the thermally conductive liquid is in contact with the shell;

installing a plurality of LEDs on a support;

inserting the support with the LEDs within the shell; and electrically connecting the plurality of LEDs to a base;

wherein the plurality of LEDs are thermally connected to the thermally conductive liquid, wherein the thermally conductive liquid and the shell are the only means to transfer heat generated by the plurality of LEDs.

17. The method as set forth in claim 16, further comprising installing a power source for the plurality of LEDs within the bulb, and wherein the power source is compatible with pre-existing power sources, permitting the bulb to be used in preexisting fixtures.

18. The method as set forth in claim 16, wherein installing the plurality of LEDs within the shell comprises:

mounting the plurality of LEDs on the support; and installing the support within the bulb, wherein the plurality of LEDs is within the shell after the support is installed.

19. The method as set forth in claim 16, wherein the plurality of LEDs is configured to emit light through the thermally conductive liquid and the shell.

20. The method as set forth in claim 16, wherein the LEDs are positioned proximate the middle of the interior volume of the shell.

* * * * *